United States Patent [19]

Zabawski et al.

[11] Patent Number: 4,986,505

[45] Date of Patent: Jan. 22, 1991

[54] ENCLOSED PATIO TABLE

[76] Inventors: Stanley M. Zabawski, Noxon Rd.; Edward L. Dombroski, 16 Catskill Ave., both of Poughkeepsie, N.Y. 12603

[21] Appl. No.: 396,070

[22] Filed: Aug. 21, 1989

[51] Int. Cl.[5] ..... A47B 5/00

[52] U.S. Cl. ..... 248/214; 248/230; 248/231.6; 108/47

[58] Field of Search ..... 248/444.1, 447.2, 146, 248/147, 150, 152, 177, 214, 225.31, 230, 231.4, 231.6, 309.1, 310, 311.2, 316.4, 316.6; 211/85, 126; 108/42, 47, 48, 46; 24/522, 486

[56] References Cited

U.S. PATENT DOCUMENTS

| | | | |
|---|---|---|---|
| 2,092,593 | 9/1937 | Seys | 24/522 |
| 2,686,701 | 8/1954 | Manczur . | |
| 2,692,174 | 10/1954 | Whitehead . | |
| 2,797,973 | 7/1957 | Culpepper . | |
| 2,867,401 | 1/1959 | Sheahan | 108/47 |
| 3,120,076 | 2/1964 | Zuch | 312/284 |
| 3,146,986 | 9/1964 | Gorth, Sr. . | |
| 3,810,598 | 5/1974 | Bender | 248/230 |
| 3,866,473 | 2/1975 | Teitelbaum | 24/486 |
| 4,575,149 | 3/1986 | Forestal | 248/231.4 |
| 4,884,966 | 12/1989 | Wexler | 312/284 |

*Primary Examiner*—Ramon O. Ramirez
*Assistant Examiner*—Robert A. Olson
*Attorney, Agent, or Firm*—Jerry T. Kearns

[57] ABSTRACT

An enclosed patio table adapted for mounting on a horizontal fence railing has a generally rectangular frame formed by an extruded aluminum member having an overlying flange formed a channel which receives edge portions of a rectangular rigid base sheet. An enclosure is mounted on the frame for movement between open and closed positions to form a protected environment for storage of food and beverages. A pair of spaced clamping mechanisms are mounted on the frame, beneath the base sheet, for clamping engagement with a horizontal fence railing.

9 Claims, 4 Drawing Sheets

ENCLOSED PATIO TABLE

BACKGROUND OF THE INVENTION

1. Field of the Invention

The present invention relates to tables, and more particularly pertains to an enclosed patio table adapted for mounting on the horizontal top railing of an outdoor fence. Various outdoor locations enjoyed by individuals for cookouts and picnics are located in close proximity to a fence having a horizontal top railing. During summer months, such outdoor cookouts and picnics are frequently plagued by flying and crawling insects attracted to food and beverage items. In order to overcome this problem, the present invention provides a patio table having an enclosure forming a protected environment for food and beverage items which include spaced clamping members for securement to a fence railing.

2. Description of the Prior Art

Various types of tables are known in the prior art. A typical example of such a table is to be found in U.S. Pat. No. 2,686,701, which issued to J. Manczur on Aug. 17, 1954. This patent discloses a detachable armchair tray table having a generally U-shaped clamping member for engagement with the padded arm of an upholstered chair. U.S. Pat. No. 2,692,174, which issued to H. Whitehead on Oct. 19, 1954, discloses an armchair tray table having a pair of pivotal spring clamping members for securement to the padded arm of an upholstered chair. U.S. Pat. No. 2,797,973, which issued to E. Culpepper on July 2, 1957, discloses a tray including pivotal clamping members for securement on the arm of a chair. U.S. Pat. No. 3,146,986, which issued to E. Gorth Sr. on Sep. 1, 1964, discloses a portable prayer book holder having pivotal spring biased clamping members for securement on the horizontal top edge of a church pew.

While the above mentioned devices are directed to tables, none of these devices disclose an enclosed patio table having a frame formed from an aluminum extrusion box beam including an overlying flange for engagement with a rigid base sheet. Additionally, none of the aforesaid devices disclose a table having a clamping mechanism for engagement with a horizontal fence railing including mirror symmetrical thumb screw actuated clamping brackets slidably mounted and selectively lockable on a threaded rod. Inasmuch as the art is relatively crowded with respect to these various types of tables, it can be appreciated that there is a continuing need for and interest in improvements to such tables, and in this respect, the present invention addresses this need and interest.

SUMMARY OF THE INVENTION

In view of the foregoing disadvantages inherent in the known types of tables now present in the prior art, the present invention provides an improved enclosed patio table. As such, the general purpose of the present invention, which will be described subsequently in greater detail, is to provide a new and improved enclosed patio table which has all the advantages of the prior art tables and none of the disadvantages.

To attain this, a representative embodiment of the concepts of the present invention is illustrated in the drawings and makes use of an enclosed patio table adapted for mounting on a horizontal fence railing which has a generally rectangular frame formed by an extruded aluminum member having an overlying flange forming a channel which receives edge portions of a rectangular rigid base sheet. An enclosure is mounted on the frame for movement between open and closed positions to form a protected environment for storage of food and beverages. A pair of spaced clamping mechanisms are mounted on the frame, beneath the base sheet, for clamping engagement with a horizontal fence railing.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved enclosed patio table which has all the advantages of the prior art tables and none of the disadvantages.

It is another object of the present invention to provide a new and improved enclosed patio table which may be easily and efficiently manufactured and marketed.

It is a further object of the present invention to provide a new and improved enclosed patio table which is of a durable and reliable construction.

An even further object of the present invention is to provide a new and improved enclosed patio table which is susceptible of a low cost of manufacture with regard to both materials and labor, and which accordingly is then susceptible of low prices of sale to the consuming public, thereby making such tables economically available to the buying public.

Still yet another object of the present invention is to provide a new and improved enclosed patio table which provides in the apparatuses and methods of the prior art some of the advantages thereof, while simultaneously overcoming some of the disadvantages normally associated therewith.

Still another object of the present invention is to provide a new and improved enclosed patio table for providing a protected environment for the storage of food and beverage items at outdoor picnics and cookouts.

Yet another object of the present invention is to provide a new and improved enclosed patio table including a clamping mechanism which is adaptable for securement on various different shapes and sizes of horizontal fence railings.

Even still another object of the present invention is to provide a new and improved enclosed patio table formed by a plurality of thin rectangular components which may be inexpensively formed and shipped in disassembled condition in a small carton.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
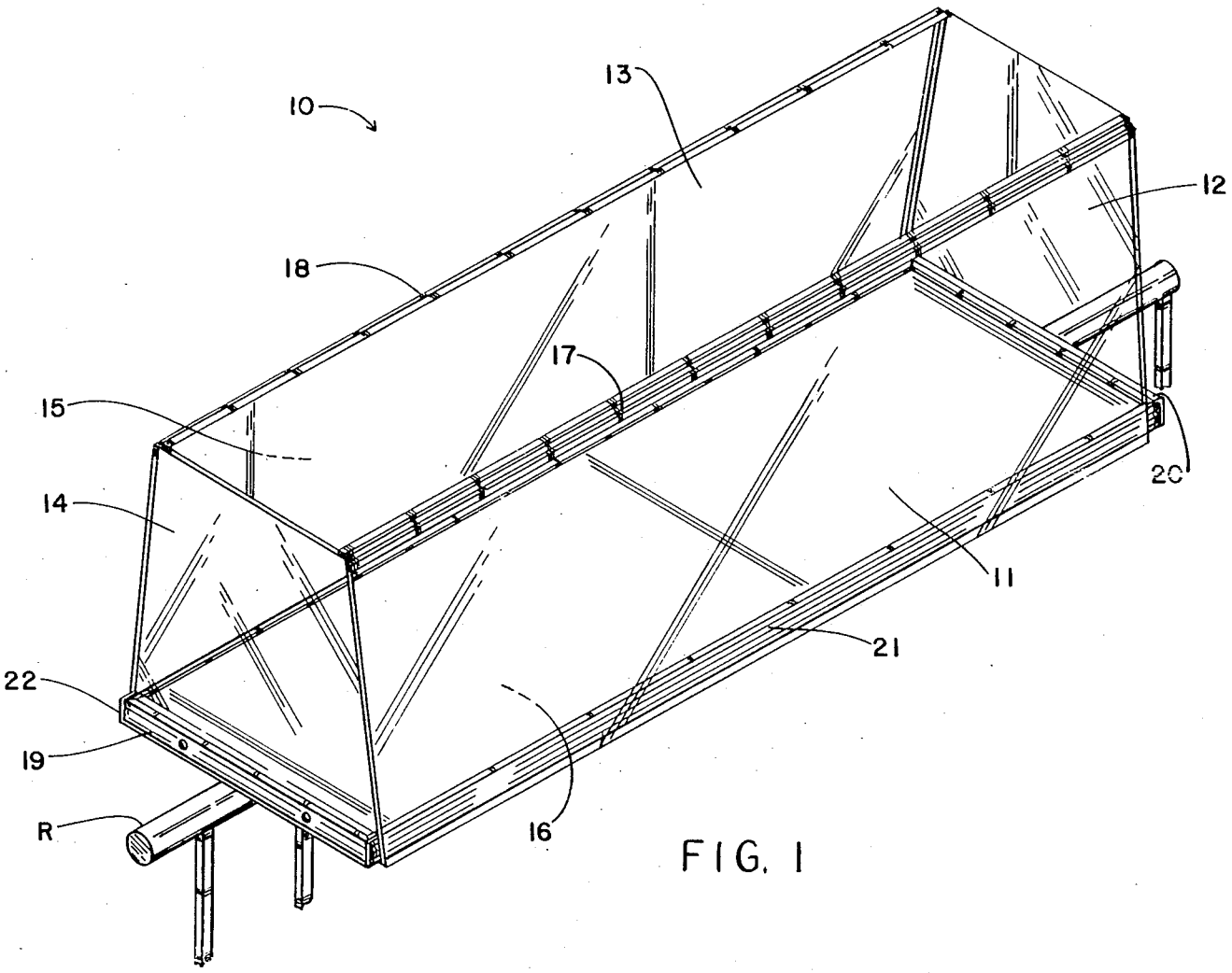
FIG. 1 is a perspective view of the enclosed patio table of the present invention.

With reference now to the drawings, and in particular to FIG. 1 thereof, a new and improved enclosed patio table embodying the principles and concepts of the present invention and generally designated by the reference numeral 10 will be described.

More specifically, it will be noted that the first embodiment 10 of the invention includes an elongated generally rectangular frame having first 21 and second 22 parallel side members connected by first 19 and second 20 spaced parallel end members. Each of the side 21, 22 and end 19, 20 members have an overlying flange forming a channel which receives edge portions of an elongated rectangular base sheet 16. The base sheet 16 is formed from a thin, rigid material such as plastic, metal or preferably a fiber board material of the type sold under the trademark MASONITE. The enclosure of the patio table is formed by a pair of parallel, stationary end plates 12 and 14 secured to the end members 20 and 19, respectively. A stationary side plate 15 is secured to the side member 22 and extends between the end plates 12 and 14. An elongated rectangular top plate 13 is secured in edge to edge relation with the side plate 15 by a first hinge 18. A rectangular front plate 11 is secured in edge to edge relation with the top plate 13 by a second hinge 17. Each of the plates 11, 12, 13, 14 and 15 forming the table enclosure may be formed from a transparent material such as plexiglass, plastic or a shatter proof glass. The stationary plates 12, 14 and 15 may be secured in position by threaded fasteners on the table frame. As illustrated, the table 10 is mountable upon the horizontal top railing R of a typical fence. The clamping mechanism will be described and illustrated subsequently.

Figure 2:
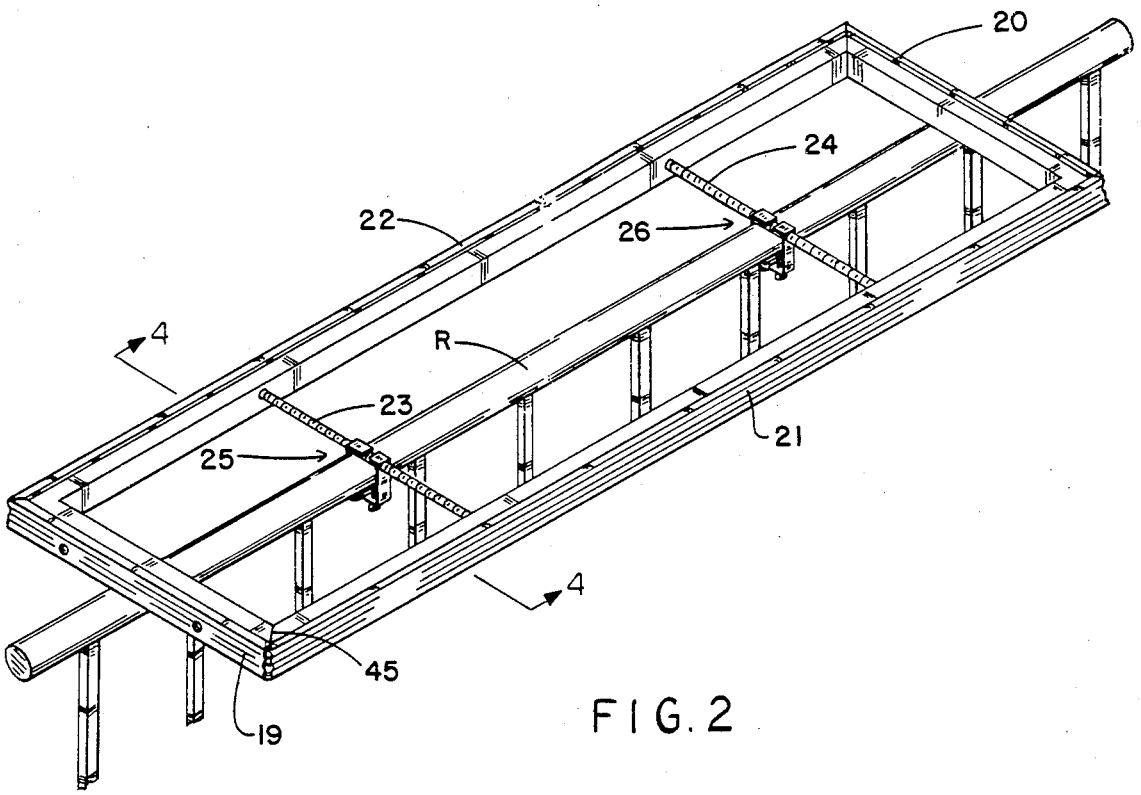
FIG. 2 is a perspective view illustrating the frame of the patio table.

FIG. 2 illustrates the frame of the table, with the enclosure and base sheet removed. The frame is secured to the railing R by a pair of spaced clamping mechanisms 25 and 26 which include transversely extending threaded rods 23 and 24 extending between the side members 21 and 22. The frame members 19, 20, 21 and 22 may be formed from a single link of a box beam type extruded aluminum member. Three of the corners 45 of the frame may be formed by providing a V-shaped notch in the extruded beam and bending the originally linear beam to form the 90 degree corners. The edges of the notched out V-portions will then be disposed in abutting relation as illustrated. The corners may then be secured through the use of threaded fasteners, or preferably by welding. The remaining fourth corner of the open rectangular frame is formed by the free ends of the originally linear extruded box beam, which have been provided with 45 degree mitered cuts. The mitered or beveled corners are then secured by the use of threaded fasteners, or by welding. This construction provides an extremely inexpensive and strong frame for the patio table.

Figure 3:
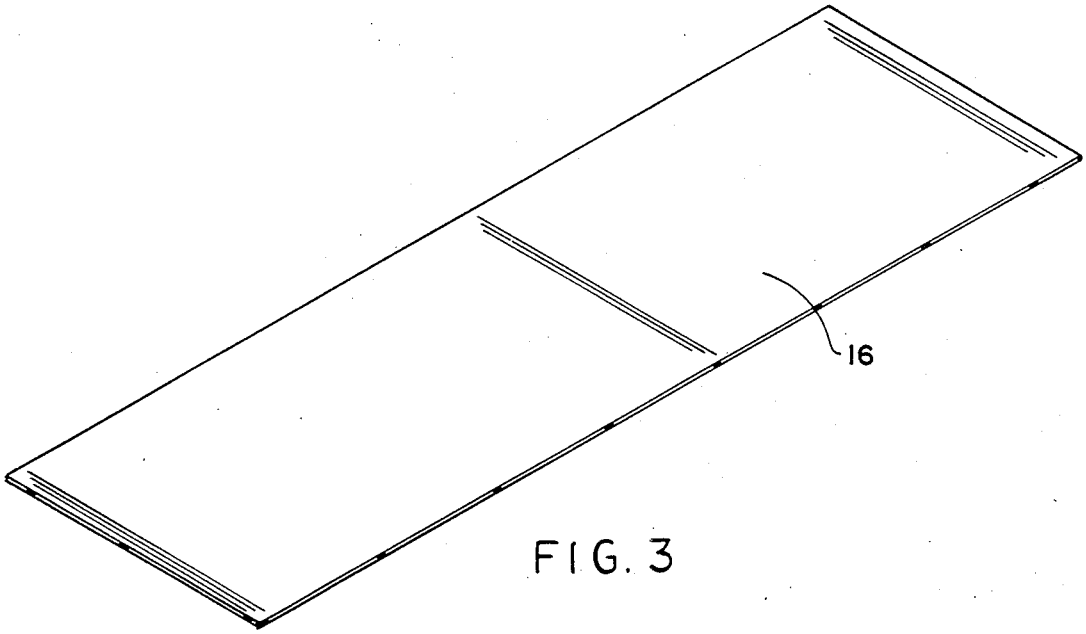
FIG. 3 is a perspective view illustrating the patio table base sheet.

FIG. 3 is a perspective view illustrating the base sheet 16, removed from the patio table.

Figure 4:
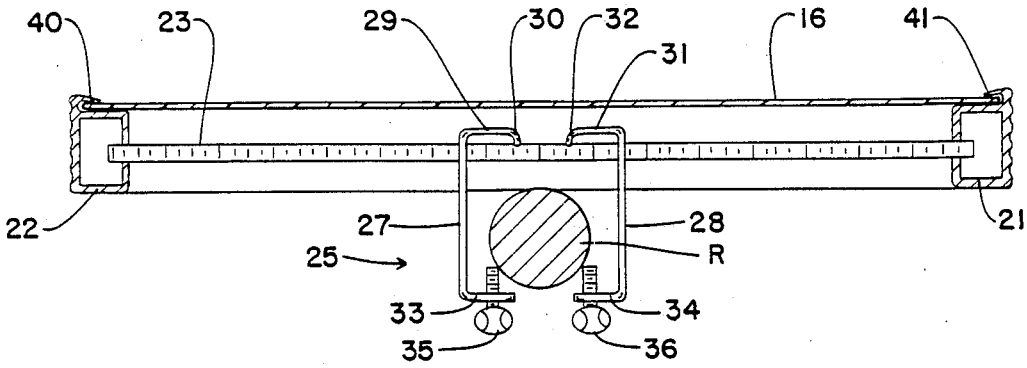
FIG. 4 is a transverse cross sectional view illustrating the clamping mechanism for securing the patio table frame on a horizontal fence railing.

FIG. 4 is a cross sectional view, taken along line 4—4 of FIG. 2, which further illustrates the construction of the railing clamping mechanism. As previously described, each of the frame members, for example 21 and 22, are formed by an aluminum extruded hollow rectangular box beam. An overlying flange, for example 40 and 41, is formed on the extruded aluminum beam, and forms a channel which frictionally retains edge portions of the thin, rigid base sheet 16. Each of the railing clamping members, for example 25, include a pair of mirror symmetrically oriented clamping brackets disposed on one of the threaded rods, for example 23. Each of the clamping brackets have a first 29 and a second 33 spaced parallel flange portions connected by a perpendicular leg portion 27. A third flange portion 30 is transversely connected to the first flange portion 29 and extends in spaced parallel relation with the leg portion 27. An aperture is formed through the leg portion 27 adjacent the first flange portion 29 and receives the threaded rod 23 with clearance. The third flange portion 30 terminates above the threaded rod 23 and has an arcuate notch dimensioned for engagement with the threaded rod 23. A thumbs screw 35 extends transversely through the second flange portion 33 for clamping engagement with the fence rail R. The other clamping bracket of the clamping mechanism 25 is symmetrically constructed and includes a first flange portion 31, a second flange portion 34, a leg portion 28 and a third flange portion 32. A thumb screw 36 extends through the second flange portion 34 for clamping engagement with adjacent the opposite side of the railing R. While the illustrated fence rail R has a circular cross sectional shape, it should be noted that the clamping mechanism 25 is equally adaptable for use with fence railings having a square or rectangular cross sectional shape.

Figure 4A:
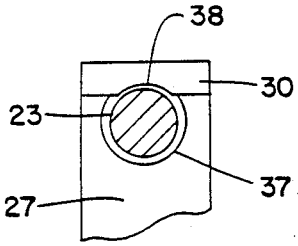
FIG. 4A is a detail view further illustrating the fence railing clamping mechanism.

FIG. 4A is a detail view which further illustrates the construction of the clamping bracket. The leg portion 27 of the bracket includes an oversized circular aperture 37 which receives the threaded rod 23 with clearance. The third flange 30 terminates above the upper surface of the rod 23 and includes an arcuate notch 38 for engagement with the rod 23. The clamping bracket is formed by bending a rectangular piece of sheet metal which has a relatively small thickness. The threaded rod 23 has a relatively coarse pitch thread which allows the edge portions of the notch 38 and aperture 37 to be disposed between two adjacent thread crests. With reference to FIG. 4, it will now be understood that by releasing the thumb screw 35, the clamping bracket 27 may be slid along the threaded rod 23. In use, each of the brackets 27 and 28 are moved to a position closely adjacent the railing R and the thumb screws 35 and 36 are tightened. This forces the edges of the notch 38 on the third flange 30 and the aperture 37 on the leg portion 27 into frictional engagement between the crests of the coarse pitch threaded rod 23. This construction provides an inexpensive clamping arrangement which is easily adaptable for use with various different cross sectional shapes and dimensions of fence railings.

Figure 5:
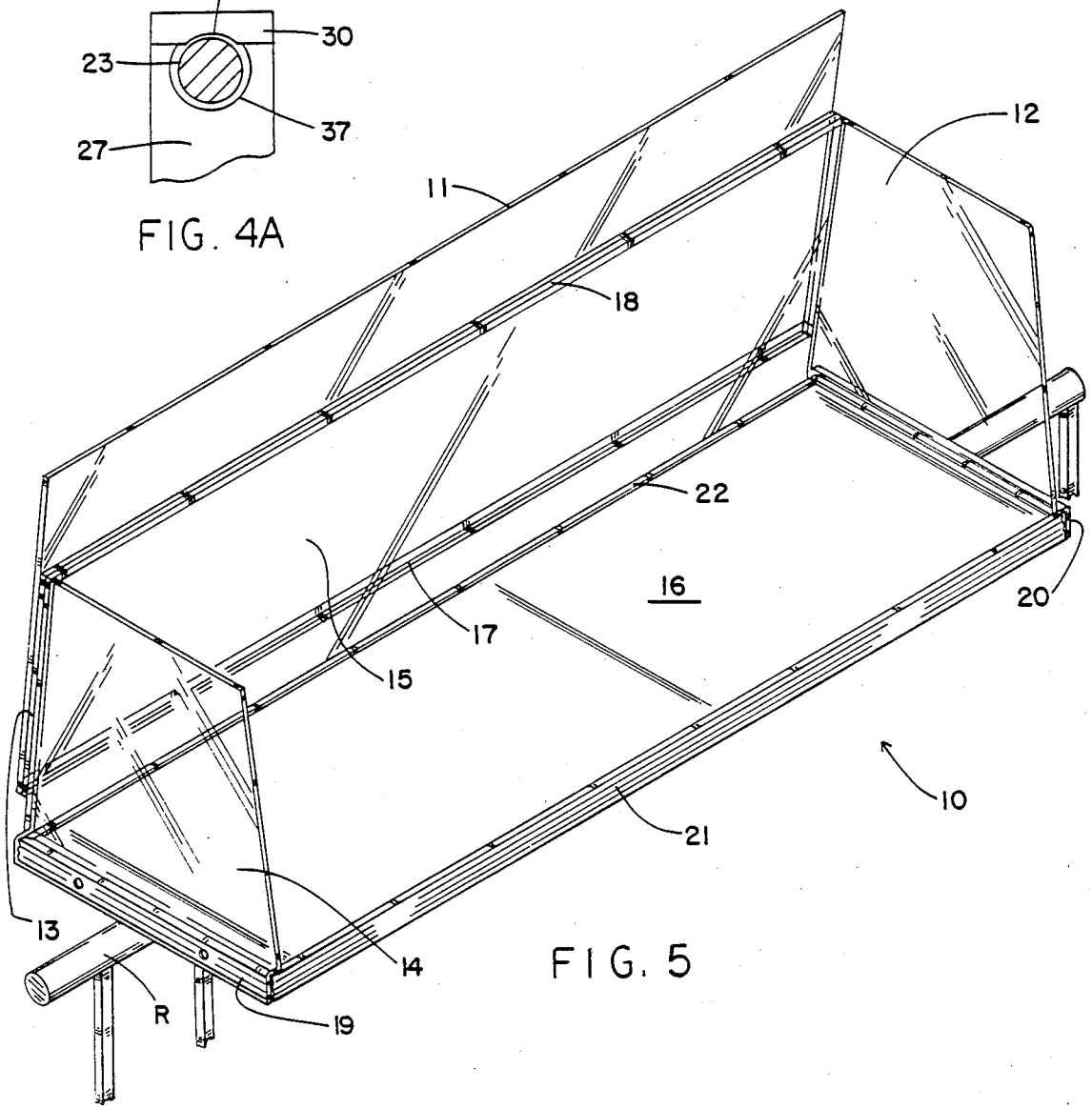
FIG. 5 is a perspective view illustrating the enclosed patio table, with the enclosure in an open position.
Figures 6A, 6B, 6C, 6D:
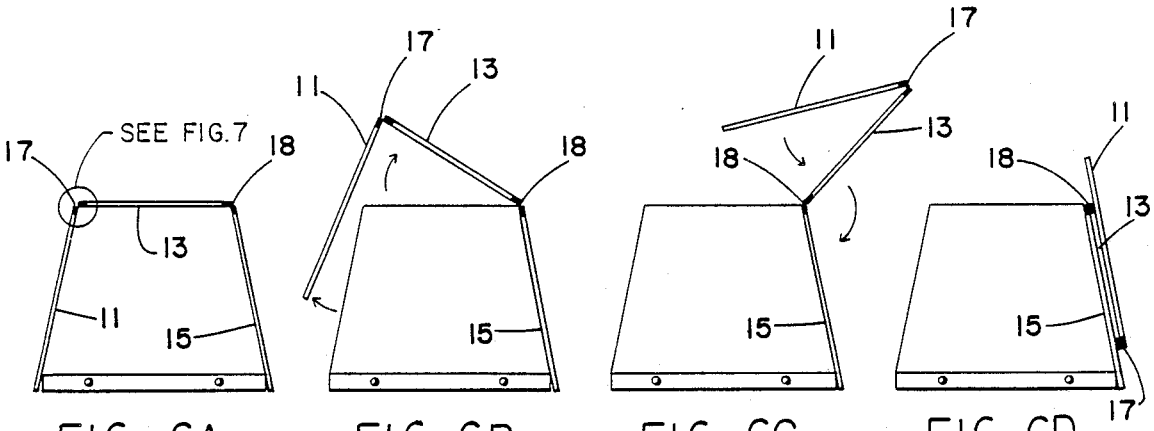
FIGS. 6A, 6B, 6C and 6D diagrammatically illustrate the manner of opening the patio table enclosure.

FIG. 5 is a perspective view which illustrates the patio table enclosure 10, with the front plate 11 and top plate 13 folded to an open position to allow access to food and beverage items which may be placed on the upper surface of the base sheet 16. It should be noted that the base sheet 16 may function as an eating table by placing a chair adjacent the railing R. As shown, the end plates 12, 14 and side plate 15, may be formed from a molded plexiglass material having an offset flange portion for nesting relation with the end members 19, 20 and side members 22. As is now apparent, the enclosure plates 11, 12, 13, 14 and 15 may be disassembled and packaged in a flat, stacked condition with the frame and base sheet 16. This allows inexpensive packaging and shipping of the table from the factory, resulting in a reduced cost to consumers.

FIGS. 6A, 6B, 6C and 6D illustrate the manner of opening the enclosure of the patio table.

Figure 7:
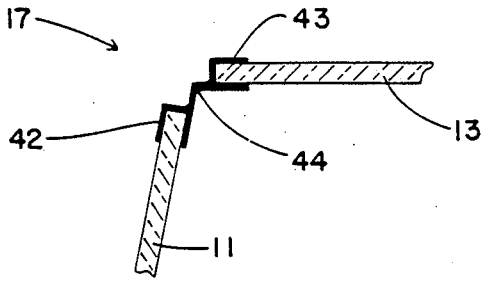
FIG. 7 is a cross sectional detail view illustrating the hinge construction for securing components of the patio table enclosure.

As shown in FIG. 7, the enclosure hinges, for example 17, include oppositely opening rectangular channel portions 42 and 43 connected by a flexible strip 44. The hinge may be inexpensively formed from a plastic extrusion. The channel portions 42 and 43 are preferably dimensioned for close conformance with the enclosure plates 11 and 13 such that a frictional clamping force is provided by the resilient nature of the channels 42 and 43. The flexible strip 44 allows pivotal movement of the plates 11 and 13 through merely a complete 360 degree arc. The other enclosure hinge 18 is formed in an identical manner. While the formation of the enclosure utilizing rectangular transparent plates is preferred because of the reduced packaging carton required dimensions, it should be noted that the enclosure may take a variety of other forms, for example, a molded transparent plastic dome or bubble having a semi-cylindrical or oval transverse cross sectional shape, may be pivotally mounted on the table for movement between open and closed positions.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An enclosed patio table adapted for mounting on a railing of a fence, comprising:

an elongated generally rectangular frame having first and second spaced parallel side members connected by first and second spaced parallel end members;

an elongated rectangular base sheet overlying said side and end members;

a plurality of spaced parallel threaded rods extending between said side members, beneath said base sheet;

a pair of mirror symmetrically oriented clamping brackets on each of said threaded rods;

each of said clamping brackets having first and second spaced parallel flange portions connected by a perpendicular leg portion, a third flange portion transversely connected to said first flange portion and extending in spaced parallel relation with said leg portion, an aperture formed through said leg portion adjacent said first flange portion, said aperture receiving said threaded rod with clearance, said third flange portion terminating above said threaded rod and having an arcuate notch for engagement with said threaded rod, and a thumb screw extending transversely through said second flange portion for clamping engagement with a fence railing; and an enclosure mounted on said frame for movement between open and closed positions, said enclosure forming a protected environment around said base sheet for storing food and beverages.

2. The enclosed patio table of claim 1, wherein said side and end members are formed from an aluminum extrusion.

3. The enclosed patio table of claim 2, further comprising an overlying flange on each of said side and end members forming a channel receiving edge portions of said base sheet.

4. The enclosed patio table of claim 1, wherein said enclosure comprises a pair of parallel end plates secured to said end members;

a side plate secured to one of said side members and extending between said end plate;

a top plate secured in edge to edge relation with said side plate by a first hinge; and a front plate secured in edge to edge relation with said top plate by a second hinge.

5. The enclosed patio table of claim 4, wherein said first and second hinges each have a pair of resilient channels dimensioned for frictional clamping engagement with edge portions of said plates, said resilient channels opening in opposite directions and connected by a flexible strip.

6. An enclosed patio table adapted for mounting on a railing of a fence, comprising:

an elongated generally rectangular frame having first and second parallel side members connected by first and second spaced parallel end members;

each of said side and end members having an overlying flange forming a channel;

an elongated rectangular base sheet formed from a rigid material and having edge portions received in said channel;

a plurality of spaced parallel threaded rods extending between said side members, beneath said base sheet;

a pair of mirror symmetrically oriented clamping brackets on each of said threaded rods;

each of said clamping brackets having first and second spaced parallel flange portions connected by a perpendicular leg portion, a third flange portion transversely connected to said first flange portion and extending in spaced parallel relation with said leg portion, an aperture formed through said leg portion adjacent said first flange portion, said aperture receiving said threaded rod with clearance, said third flange portion terminating above said threaded rod and having an arcuate notch for engagement with said threaded rod, and a thumb screw extending transversely through said second flange portion for clamping engagement with a fence railing;

a pair of parallel end plates secured to said end members;

a side plate secured to one of said side members and extending between said end plates;

a top plate secured in edge to edge relation with said side plate by a first hinge;

a first plate secured in edge to edge relation with said top plate by a second hinge; and said first and second hinges each having a pair of resilient channels dimensioned for frictional clamping engagement with edge portions of said plates, said resilient channels opening in opposite directions and connected by a flexible strip.

7. An enclosed patio table adapted for mounting on a railing of a fence, comprising:

an elongated generally rectangular frame having first and second spaced parallel side members connected by first and second spaced parallel end members;

enclosure means mounted on said frame means for movement between open and closed positions;

each of said side and end members have an overlying flange forming a channel;

an elongated rectangular base sheet formed from a rigid material having edge portions received in said channels;

a plurality of spaced parallel threaded rods extending between said side members, beneath said base sheet;

a pair of mirror symmetrically oriented clamping brackets on each of said threaded rods; and each of said clamping brackets having first and second spaced parallel flange portions connected by a perpendicular leg portion, a third flange portion transversely connected to said first flange portion and extending in spaced parallel relation with said leg portion, an aperture formed through said leg portion adjacent said first flange portion, said aperture receiving said threaded rod with clearance, said third flange portion terminating above said threaded rod and having an arcuate notch for engagement with said threaded rod, and a thumb screw extending transversely through said second flange portion for clamping engagement with a fence railing.

8. The enclosed patio table of claim 7, wherein said enclosure means comprises:

a pair of parallel end plates secured to said end members;

a side plate secured to one of said side members and extending between said end plate;

a top plate secured in edge to edge relation with said side plate by a first hinge; and a first plate secured in edge to edge relation with said top plate by a second hinge.

9. The enclosed patio table of claim 8, wherein said first and second hinges each have a pair of resilient channels dimensioned for frictional clamping engagement with edge portions of said plates, said resilient channels opening in opposite directions and connected by a flexible strip.

* * * * *